US005995809A

United States Patent [19]

Kobayashi

[11] Patent Number: 5,995,809

[45] Date of Patent: Nov. 30, 1999

[54] PORTABLE RADIO APPARATUS

[75] Inventor: Fumiyuki Kobayashi, Tokyo, Japan

[73] Assignee: NEC Corporation, Tokyo, Japan

[21] Appl. No.: 08/789,134

[22] Filed: Jan. 28, 1997

[30] Foreign Application Priority Data

Jan. 29, 1996 [JP] Japan ..... 8-012936

[51] Int. Cl.[6] ..... H01Q 1/24

[52] U.S. Cl. ..... 455/90; 455/351

[58] Field of Search ..... 455/280, 89, 561, 455/101, 272, 271, 281, 277.1, 279.1, 90, 347, 351; 343/702, 900, 715

[56] References Cited

U.S. PATENT DOCUMENTS

| | | | |
|---|---|---|---|
| 3,626,416 | 12/1971 | Rabow | 455/90 |
| 4,663,632 | 5/1987 | Budrow et al. | 343/714 |
| 4,850,031 | 7/1989 | Allsop et al. | 455/90 |
| 5,121,504 | 6/1992 | Toko | 455/90 |
| 5,166,695 | 11/1992 | Chan et al. | 343/702 |
| 5,335,367 | 8/1994 | Adachi et al. | 455/90 |
| 5,392,054 | 2/1995 | Bottomley et al. | 343/702 |
| 5,448,251 | 9/1995 | Gerszberg et al. | 343/702 |
| 5,535,435 | 7/1996 | Balzano et al. | 455/89 |
| 5,630,211 | 5/1997 | Nagai | 455/89 |
| 5,640,689 | 6/1997 | Rossi | 455/89 |
| 5,714,958 | 2/1998 | Rudisill | 343/702 |
| 5,918,189 | 6/1999 | Nishiyama | 455/90 |

FOREIGN PATENT DOCUMENTS

| | | |
|---|---|---|
| 0624021 | 11/1994 | European Pat. Off. . |
| 0650282 | 4/1995 | European Pat. Off. . |
| 60-47502 | 3/1985 | Japan . |
| 60-48626 | 3/1985 | Japan . |
| 4-14325 | 1/1992 | Japan . |
| 4-330830 | 11/1992 | Japan . |
| 548965 | 10/1942 | United Kingdom . |

*Primary Examiner*—Salvatore Cangialosi
*Attorney, Agent, or Firm*—Sughrue, Mion, Zinn, Macpeak & Seas, PLLC

[57] ABSTRACT

A portable radio apparatus has a housing containing electronic circuits, a pair of antennas which are each retractable, and a gear mechanism which links the antennas through a predetermined number of gear wheels so that an extending and retracting action of one antenna is transmitted to the other antenna. The gear mechanism includes a pair of racks provided on the antennas, respectively, and a gear assembly including the predetermined number of gear wheels which are meshed in series, both end gear wheels of the gear assembly engaging with the racks, respectively.

17 Claims, 4 Drawing Sheets

PORTABLE RADIO APPARATUS

BACKGROUND OF THE INVENTION

1. Field of the Invention

The present invention generally relates to a portable radio apparatus having multiple antennas and, in particular, to the antenna extending and retracting mechanism of a portable radio apparatus.

2. Description of the Related Art

In a portable radio apparatus, spatial diversity can be implemented using multiple antennas. Some radio apparatus are provided with a pair of antennas and others with a retractable antenna and a built-in antenna incorporated in the housing thereof. In the case of the radio apparatus having a pair of antennas, it is preferable that these two antennas are mechanically linked so as to be simultaneously extended and retracted. Such an antenna extending and retracting mechanism has been disclosed in Japanese Patent Unexamined Publication No. 4-330830, as shown in FIG. 1.

Referring to FIG. 1, two retractable antennas 11 and 12 providing spatial diversity are implemented in the body 10 of a radio telephone apparatus. These two antennas 11 and 12 are mechanically linked through two cords 15 riding on two pulleys 13 and 14, respectively, so that they are simultaneously extended and retracted in opposite directions.

However, such a cord-and-pulley arrangement is complicated and needs rather large mounting space within the housing, resulting in the reduced space for implementing electronic devices. Therefore, according to the conventional mechanism, it is difficult to reduce the size and weight of the portable radio apparatus.

SUMMARY OF THE INVENTION

An object of the present invention is to provide a portable radio apparatus having a simple and small-size mechanism which mechanically links a pair of antennas so as to ensure coordinated extending and retracting action.

Another object of the present invention is to provide a portable radio apparatus having a simple and small-size mechanism which mechanically links a pair of antennas so as to ensure coordinated extending and retracting action in one direction.

According to the present invention, a pair of antennas are linked by a gear mechanism. More specifically, a portable radio apparatus is comprised of a housing, a pair of antennas which are each retractable, and a gear mechanism which links the antennas through a predetermined number of gear wheels so that an extending and retracting action of one antenna is transmitted to the other antenna. The gear mechanism is preferably comprised of a pair of racks provided on the antennas, respectively, and a gear assembly comprising the predetermined number of gear wheels which are meshed in series, both end gear wheels of the gear assembly engaging with the racks, respectively. In the case where an even number of gear wheels are preferably provided, the antennas are simultaneously extended and retracted in the same direction. Further preferably, the gear mechanism is placed at an end portion of the housing.

Employing such a gear mechanism achieves a simple and small-size mechanism which mechanically links a pair of antennas so as to ensure coordinated extending and retracting action. Especially, an even number of gear wheels provided in the gear mechanism allows a pair of antennas to be simultaneously extended and retracted in the same direction and to be placed at an end portion of the housing. Therefore, the remaining space is effectively used for the electronic devices.

DETAILED DESCRIPTION OF THE PREFERRED EMBODIMENT

Figure 1:
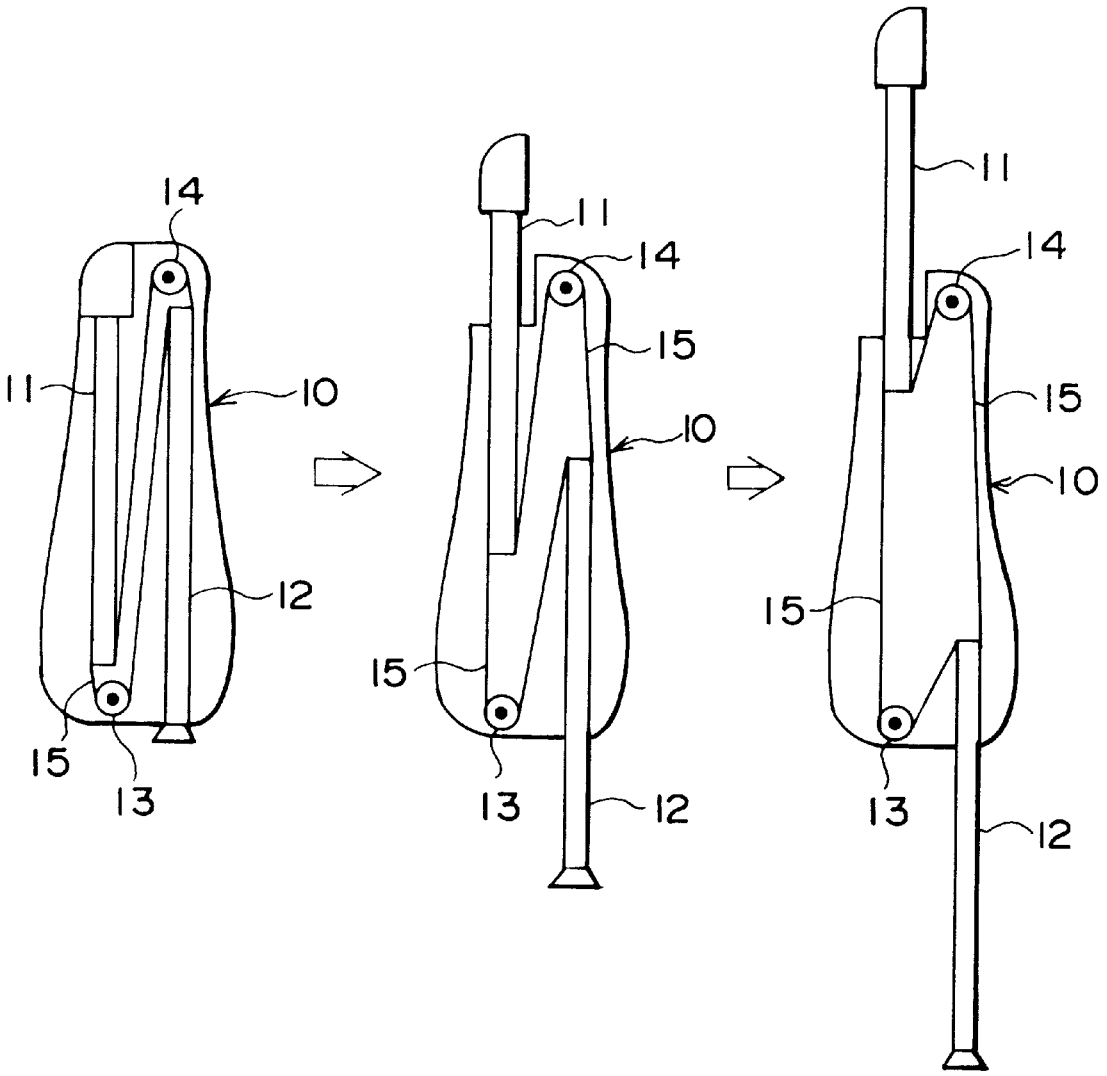
FIG. 1 (PRIOR ART)
FIG. 1 is a diagram showing a conventional antenna extending and retracting mechanism of a portable radio apparatus.
Figure 2:
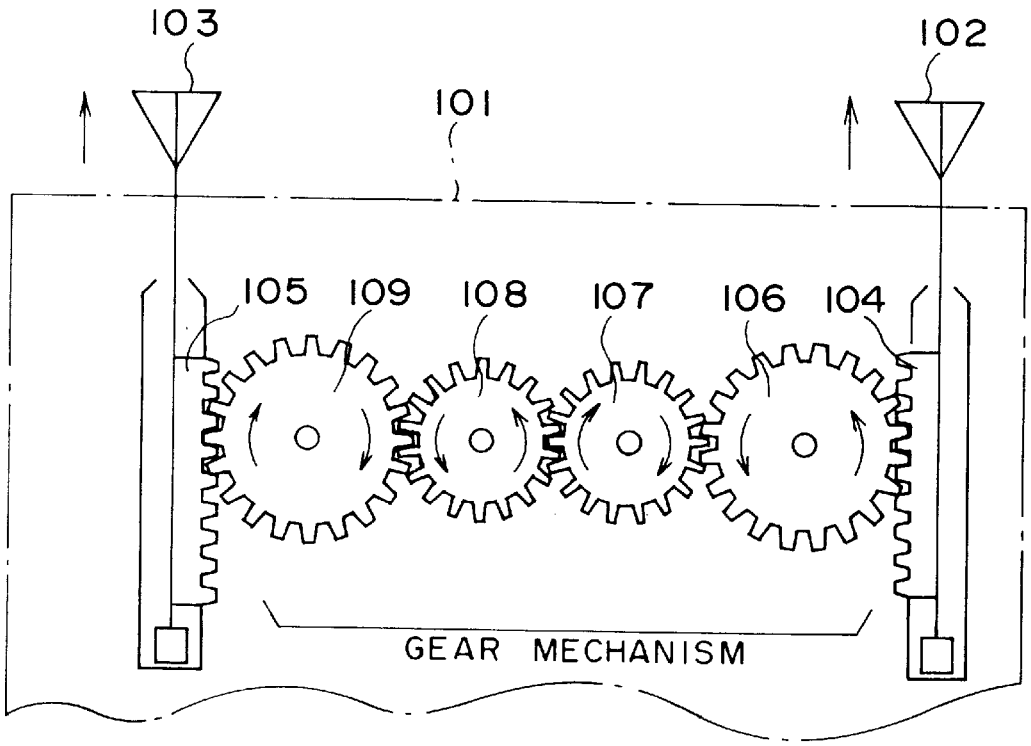
FIG. 2 is a schematic diagram showing an antenna extending and retracting mechanism according to an embodiment of the present invention.

Referring to FIG. 2, there is shown a gear mechanism for extending and retracting a pair of antennas in accordance with the present invention. A housing 101 of a portable radio apparatus contains a pair of antennas 102 and 103 as well as the gear mechanism by which the two antennas 102 and 103 are simultaneously extended and retracted. More specifically, the gear mechanism is comprised of two racks 104 and 105 provided on the antennas 102 and 103, respectively, and an even number of gear wheels 106–109. The rack 104 is provided on one side of the antenna 102 and similarly the rack 105 on one side of the antenna 103 so that these racks are opposite to each other.

The teeth of the rack 104 are adapted to engage with the teeth of the gear wheel 106, forming a rack-and-pinion assembly. The gear wheels 106–109 are meshed in series and the teeth of the gear wheel 109 are adapted to engage with the teeth of the rack 105, forming another rack-and-pinion assembly. Such a gear mechanism transmits the extending and retracting motion of one antenna to the other antenna. In the case where the two antennas 102 and 103 move in one direction, the number of gear wheels is even. For example, when one antenna 102 is extended by a user, the rectilinear motion of the antenna 102 is converted to circular motion by the rack 104 and the gear wheel 106. The circular motion is transmitted by the gear wheels 106–109 and is converted back to the rectilinear motion of the other antenna 103 by the gear wheel 109 and the rack 105. Therefore, the two antennas 102 and 103 are simultaneously extended and retracted in the same direction.

Figure 3:
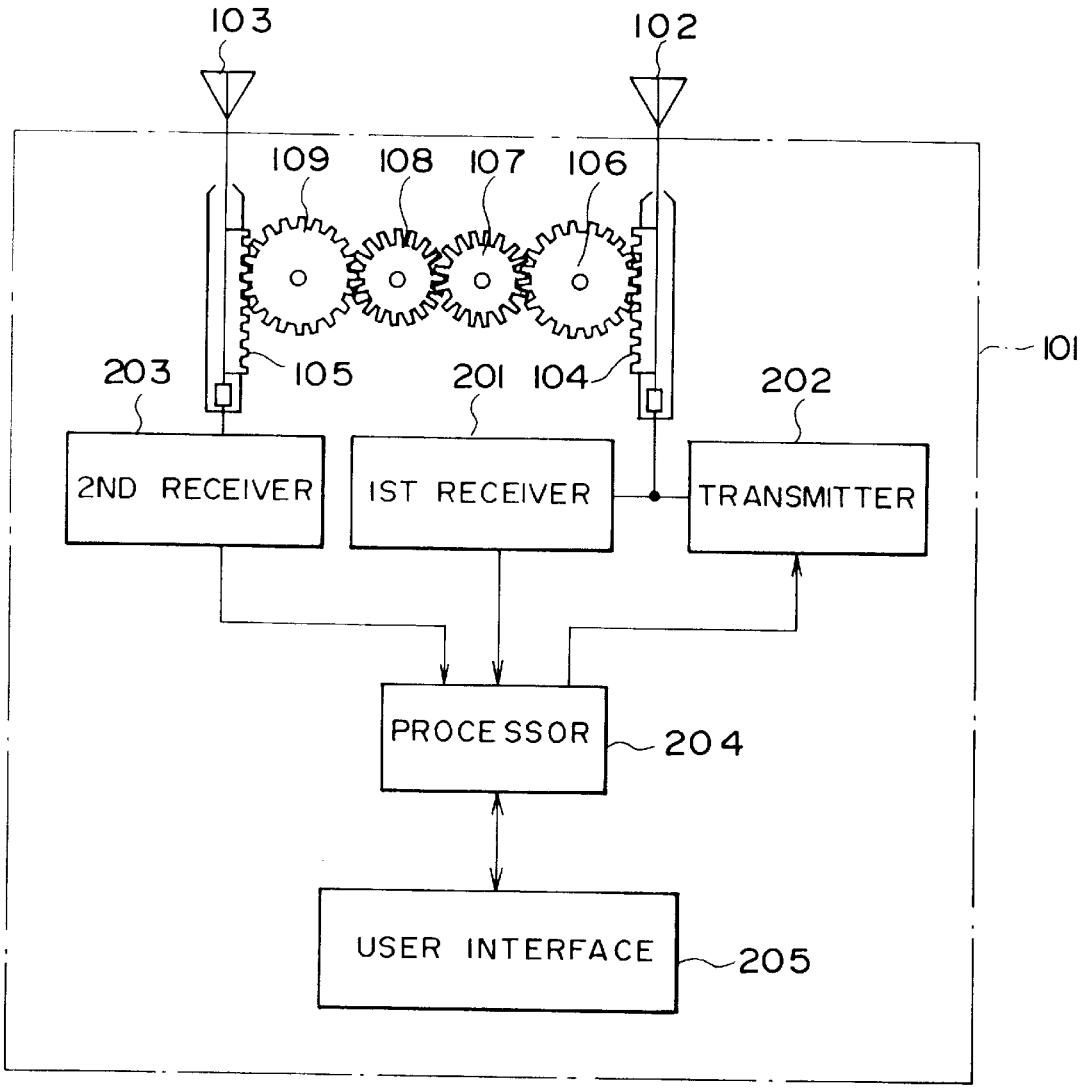
FIG. 3 is a schematic block diagram showing an internal circuit of a portable radio apparatus according to the embodiment.

Referring to FIG. 3, the housing 101 also contains the electronic circuits for transmitting and receiving radio signals. In this embodiment, the transmitting and receiving antenna 102 is electrically connected to a first receiver 201 and a transmitter 202, and the other antenna 103 for diversity receiving is electrically connected to a second receiver 203. The receiving and transmitting operations are controlled by a processor 204 which processes received and transmitted signals. The processor 204 is electrically connected to a user interface 205, for instance, a keypad, a display, a microphone, and a speaker. These electronic devices 201–205 as well as the gear mechanism are contained in the housing 101, as will be described hereinafter.

Figure 4:
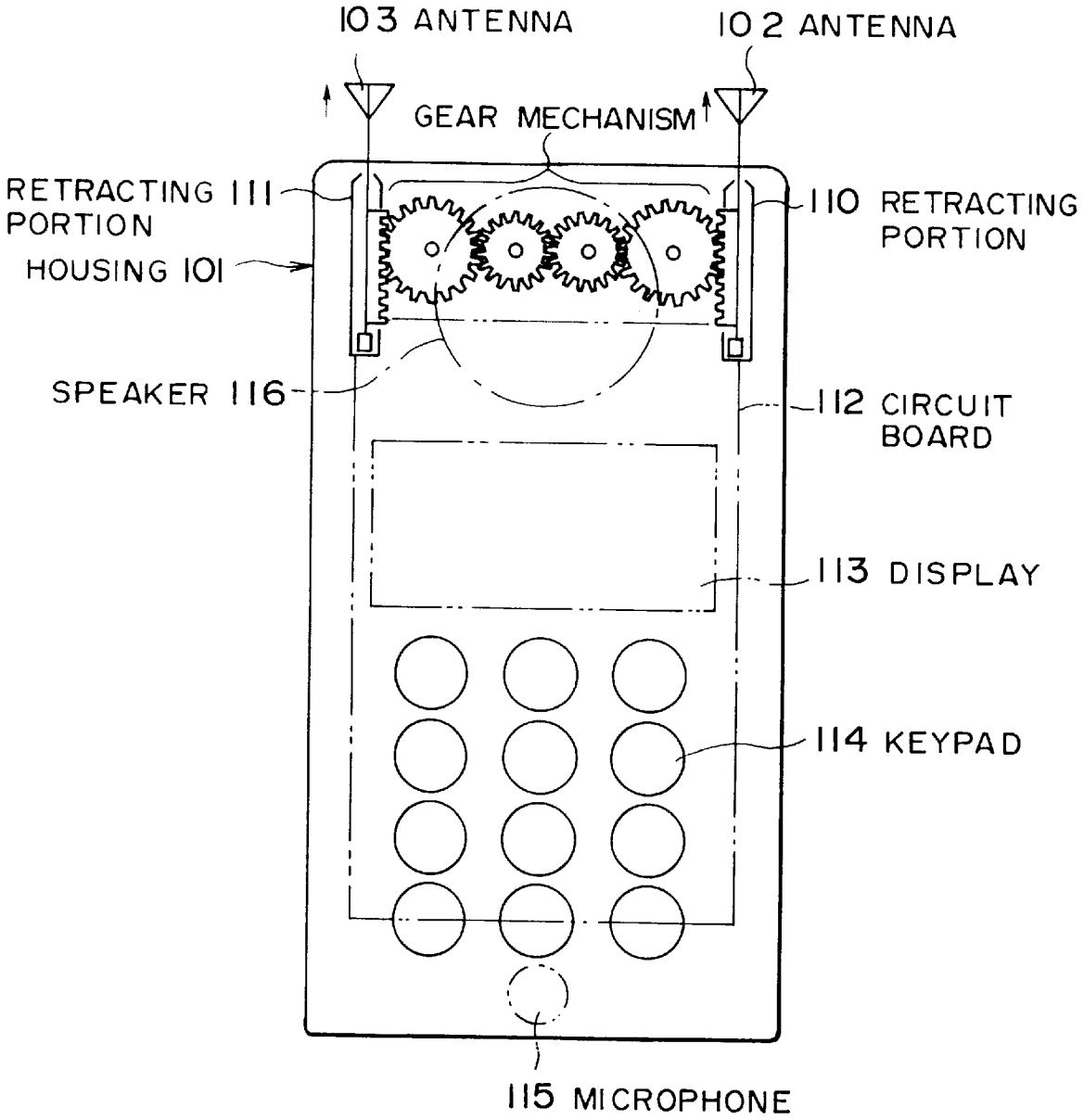
FIG. 4 is a schematic plan view showing a portable radio apparatus which houses the antenna extending and retracting mechanism according to the embodiment.

Referring to FIG. 4, the housing 101 of the portable radio apparatus has the above-mentioned gear mechanism and antenna retracting portions 110 and 111 placed in the upper portion thereof. The respective gear wheels 106–109 are rotatable around axes connected to the housing 101 so as to transmit the circular motion of one adjacent gear wheel to the others Therefore, when the user can extend and retract one antenna, the other antennas is simultaneously extended and retracted because of the gear mechanism transmitting the action of one antenna to the other.

The housing 101 contains a circuit board 112 mounted with the electronic devices forming a communication circuit. The display 113 and the keypad 114 which are electrically connected to the circuit board 112 are placed on the major surface of the housing 101. Further, the microphone 115 and the speaker 116 are installed in the lower and the upper portions of the major surface of the housing, respectively. As shown in the figure, the antennas and the gear mechanism are allowed to be placed in the upper portion of the housing 101. Therefore, the remaining space inside the housing 101 can be effectively used for the electronic circuits and other necessary devices.

As described above, since the gear mechanism according to the present invention requires smaller space than the conventional one, enough space to implement the electronic devices can be ensured, resulting in the reduced size and weight of the radio apparatus.

What is claimed is:

1. A portable radio apparatus, comprising:

a housing;

a pair of antennas comprising a first antenna and a second antenna, both of said first and second antennas being electrically connected to an electronic circuit contained in the housing, and each of said first and second antennas being retractable in the housing; and gear means mechanically linking the pair of antennas together through a predetermined number of meshed gear wheels so that extension and retraction movements of one antenna are transmitted to the other antenna.

2. The portable radio apparatus according to claim 1, wherein the gear means comprises:

a pair of geared racks, comprising a first geared rack and a second geared rack provided on said first antenna and said second antenna, respectively; and a gear assembly, comprising a predetermined number of gear wheels which are meshed in series, wherein a gear wheel at one end of the gear assembly engages with said first geared rack and a gear wheel at another end of the gear assembly engages with said second geared rack, respectively.

3. The portable radio apparatus according to claim 1, wherein said pair of antennas simultaneously extend and retract in one direction.

4. The portable radio apparatus according to claim 3, wherein the gear means comprises an even number of gear wheels.

5. The portable radio apparatus according to claim 1, wherein the gear means is placed at an end portion of the housing.

6. The portable radio apparatus according to claim 5, wherein the gear means is placed at an upper portion of the housing.

7. The portable radio apparatus according to claim 4, wherein the gear means is placed at an end portion of the housing.

8. The portable radio apparatus according to claim 1, wherein the antennas and the radio system provide spatial diversity.

9. A portable radio apparatus, comprising:

a housing;

a plurality of electronic devices contained in the housing;

a pair of antennas comprising a first antenna and a second antenna, both of said first and second antennas being electrically connected to an electronic device contained in the housing, and each of said first and second antennas being retractable in the housing; and gear means comprising an even number of gear wheels, wherein said gear means transmits an extension and retraction movement of one of said first or second antenna to the other of said first or second antenna so that said pair of antennas is simultaneously extended and retracted in the same direction.

10. The portable radio apparatus according to claim 9, wherein the gear means comprises:

a pair of racks provided on the antennas, respectively; and a gear assembly comprising the gear wheels which are meshed in series, both end gear wheels of the gear assembly engaging with the racks, respectively.

11. The portable radio apparatus according to claim 10, wherein said pair of antenna and said near means are placed at an end portion of the housing and said electronic devices are installed in the space not occupied by the gear means.

12. The portable radio apparatus according to claim 9, wherein said even number of gear wheels consists of two gear wheels.

13. The portable radio apparatus according to claim 9, wherein said even number of gear wheels consists of four gear wheels.

14. The portable radio apparatus according to claim 9, wherein said even number of gear wheels consists of six gear wheels.

15. The portable radio apparatus according to claim 10, wherein said even number of gear wheels consists of two gear wheels.

16. The portable radio apparatus according to claim 10, wherein said even number of gear wheels consists of four gear wheels.

17. The portable radio apparatus according to claim 10, wherein said even number of gear wheels consists of six gear wheels.

* * * * *